United States Patent [19]

Price et al.

[11] Patent Number: 4,755,009

[45] Date of Patent: Jul. 5, 1988

[54] WORK STATION APPARATUS FOR WORD PROCESSING EQUIPMENT

[75] Inventors: Macy J. Price, Golden; Mario B. Accummanno, Denver; John T. Molk, Englewood; Laurence G. Ball, Thornton, all of Colo.

[73] Assignee: Engineered Data Products, Inc., Broomfield, Colo.

[21] Appl. No.: 720,068

[22] Filed: Apr. 5, 1985

[51] Int. Cl.[4] ..... A47B 21/00

[52] U.S. Cl. ..... 312/194; 248/139; 248/188.5; 312/72; 312/208

[58] Field of Search ..... 312/194, 203, 208, 20, 312/7.2, 279, 213; 108/1, 4; 248/1 A, 132, 188.5, 139, 133, 1 B; D14/103

[56] References Cited

U.S. PATENT DOCUMENTS

| | | | |
|---|---|---|---|
| D. 233,759 | 11/1974 | Pycha et al. | D14/103 |
| 236,351 | 8/1875 | Clayton . | |
| 472,099 | 4/1892 | Wyns . | |
| 861,810 | 7/1907 | Coblentz | 248/133 |
| 2,341,125 | 2/1944 | Spear | 312/194 X |
| 2,646,325 | 7/1953 | Abrahamson | 312/194 X |
| 2,853,351 | 9/1958 | Bassett | 312/194 |
| 3,365,259 | 1/1968 | Heisman et al. | 312/194 |
| 3,940,136 | 2/1976 | Runte . | |
| 4,073,556 | 2/1978 | Wilson, Jr. | 248/1 A X |
| 4,313,112 | 1/1982 | Foster . | |
| 4,316,082 | 2/1982 | Fritz | 248/1 B X |
| 4,372,515 | 2/1983 | Noonan . | |
| 4,410,159 | 10/1983 | McVicker et al. . | |
| 4,428,631 | 1/1984 | Cope et al. | 312/194 |
| 4,449,762 | 5/1984 | Turner | 312/194 X |
| 4,453,689 | 6/1984 | Ellis et al. | 248/188.1 |
| 4,590,866 | 5/1986 | Schairbaum | 312/7.2 X |

FOREIGN PATENT DOCUMENTS

| | | | |
|---|---|---|---|
| 1106895 | 8/1981 | Canada . | |
| 2839770 | 3/1980 | Fed. Rep. of Germany | 312/194 |
| 3308872 | 9/1984 | Fed. Rep. of Germany | 312/20 |
| 577677 | 9/1924 | France | 312/279 |
| 619022 | 3/1949 | United Kingdom | 312/194 |

OTHER PUBLICATIONS

Electronic Desk Brochure by Engineered Data Products, 2 pages.

Electronic Desk Brochure, Cat. C52, Global Computer Supplies, 2 pages.

Jeff Guinn, "FW Man Markets 'Electronic Desk'", 2/2/1985, *Star Telegram Writer,* Ed Schairbaum (inventor), 2 pages.

Kathryn Jones, "High Tech Comes to Desk", *Dallas Times Herald,* Ed Schairbaum (inventor).

Publisher's Note, 5/1985, "A Desk with Brains", Computer *User Magazine.*

Electronic Desk Brochure by TNG, 2 pages.

*Primary Examiner*—Peter A. Aschenbrenner
*Assistant Examiner*—Thomas A. Rendos
*Attorney, Agent, or Firm*—Klaas & Law

[57] ABSTRACT

A work station apparatus resembling a conventional flat top desk in which is housed a cathode ray tube (CRT) type computer display terminal unit, a central processing unit (CPU) usually including the disc drive, a keyboard unit and a printer unit. The CRT display unit is mounted on support stand means for permitting movement of the CRT display unit anywhere within a three dimensional field and rotation about a horizontal axis and a vertical axis.

20 Claims, 2 Drawing Sheets

WORK STATION APPARATUS FOR WORD PROCESSING EQUIPMENT

BACKGROUND AND SUMMARY OF THE INVENTION

This invention relates to a desk type apparatus for housing components of a micro and personal computer comprising a CPU (central processing unit), a monitor and a printer unit. The central processing unit often houses disc drives.

For many years, great technological advances have been made in data and word processing equipment. At the present time, many new and improved computer type word processing systems are being marketed.

However, acceptable developments of new and improved work station equipment have not kept pace with the development of data processing and computer equipment. While some attempts have been made to satisfy the long known need for new and improved work station equipment, to date, there has been no generally satisfactory solution. Some of the prior art attempts are illustrated in the following United States patents: Foster U.S. Pat. No. 4,313,112 and Clayton et al. U.S. Pat. No. Des. 236,351.

A substantial improvement in such work station equipment is disclosed in co-pending United States patent application Ser. No. 580,804, filed Feb. 16, 1984, of E. C. Schairbaum now U.S. Pat. No. 4,590,866. However, the foregoing improvement does not satisfy the demand for low cost, highly efficient work station equipment.

In general, the present invention comprises a work station unit having an appearance resembling a conventional desk, but which is capable of housing a cathode ray tube (CRT) type computer display terminal unit, a central processing unit (CPU) usually including the disc drive, a keyboard unit, and a printer unit in a new and improved manner. The top panel of the desk is provided with a central transparent section enabling viewing of the CRT unit which is mounted below the transparent desk top panel on adjustable support means. The keyboard unit is mounted in a central desk drawer for movement between a retracted stored position beneath the desk top panel and an extended operating position. The printer unit is mounted in a first side drawer for movement between a retracted stored position beneath the desk top panel and an extended operating position. The CPU (central Processing unit) which includes the disc drive is mounted in a second side drawer unit for movement between a normal retracted stored position beneath the desk top panel and an extended position for access thereto. Additional drawer units or storage space may be provided for paper, storage disks and work product materials.

BRIEF DESCRIPTION OF THE DRAWING

A presently preferred illustrative embodiment of the invention is shown in the accompanying drawings in which.

DETAILED DESCRIPTION OF THE INVENTION

Figure 1:
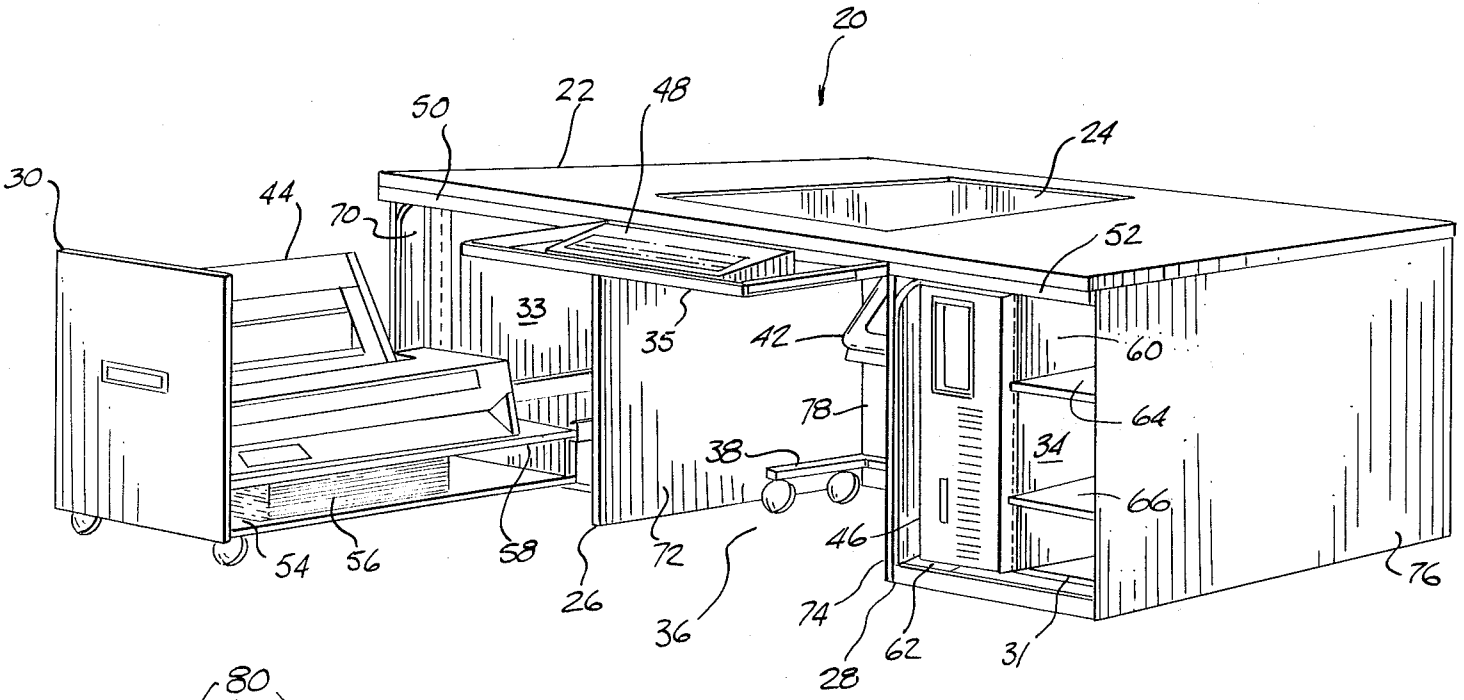
FIG. 1 is a perspective view of the apparatus.
Figure 2:
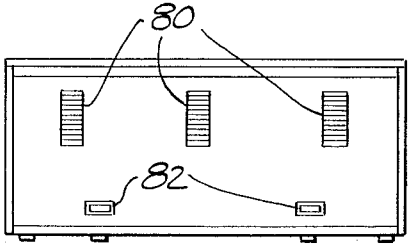
FIG. 2 is a front elevational view of the apparatus.

In general, as shown in FIG. 1, the apparatus and system of the present invention comprises a desk-type work station means 20 having an upper top panel means 22 with a transparent central panel portion 24; a pair of spaced pedestal means 26, 28 including one or more slidable drawer unit means 30, 31 mounted in storage space means 33, 34, a central slidable drawer means 35, a central space means 36, and a central CRT support means 38 located beneath the central transparent panel portion 24.

The construction and arrangement of the work station unit is such as to enable an operator to sit on a chair means (not shown) in front of the central space means 36 and have access to and operate various component units of a conventional word processing, computer-type system. A conventional CRT display means unit 42 is adjustably mounted on the central CRT support means 38 in a position enabling viewing by the operator through the transparent central panel portion 24. A conventional printer means unit 44 is mounted in one of the side drawer means 30. A conventional central processing unit, CPU means unit 46, is mounted on another one of the side drawer means 31. A conventional keyboard-type data input means 48 is supported in the central drawer means 35. Conventional overhead door means 50, 52 are movable from a stored overhead horizontal position to beneath top panel means 22 to a vertical position housing storage space means 33, 34 and may be provided with suitable locking means (not shown). Central drawer means 35 may also have such locking means.

In operation, as shown in FIG. 1, central drawer means 35 is pulled outwardly to an operating position for access to the data input means 48. Door means 50 is raised and drawer means 30 is pulled outwardly to an operation position for access to printer means 44. Door means 52 is raised to provide access to CPU means 46. Movable shelf means 31 normally remains in the retracted position during operation of the system, but may be pulled outwardly to enable full access to the CPU means 46. The position of the CRT unit may be adjusted for a particular operator by outward movement of CRT support means 38 for access to the adjustment apparatus. Then, the CRT support means 38 is pushed back into central space 36 beneath glass portion 24. When the work station is not in use, the printer drawer means 30 may be closed and door means 50 may be lowered and locked; central drawer means 35 may be closed and locked; and CPU door means 52 may be lowered and locked.

A storage space means 54 for paper or the like 56 may be provided below an adjustable printer unit means shelf 58. A central vertical panel 60 in storage space 34 provides a compartment 62 for CPU means 46 and may be adjustably mounted to accommodate different size CPU units. The other space maybe divided by adjustable shelf members 64 and 66. The door and drawer track and roller mechanisms and shelf and panel adjustment mechanisms are conventional. Also, the general desk construction mounting and fastening elements are also conventional. In general, the desk unit comprises top horizontal panel means 22; spaced laterally extending vertical panel means 70, 72, 74, 76 which define spaces 33, 34, 36; and a longitudinally extending vertical front panel means 78 which may be made of conventional desk materials such as wood or metal or the like. A plurality of openings 80 in the front panel means 78 for permitting the movement of conditioning air into storage space means 33 and 34 and central space means. Also, the front panel means is provided with handle means 82.

Figures 3, 4:
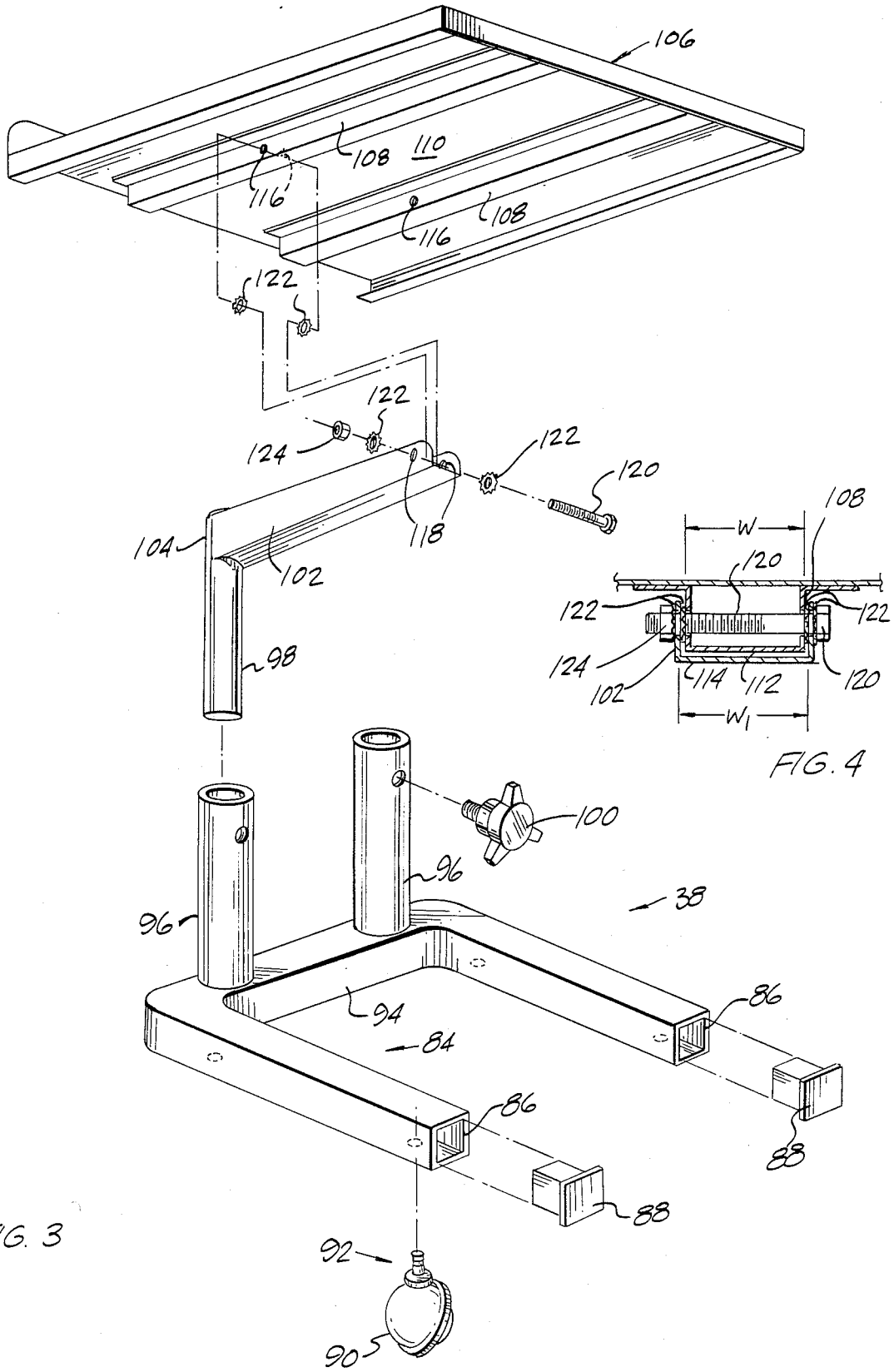
FIG. 3 is an exploded view of the CRT support means.
FIG. 4 is an assembled view of the adjustable pivotal mounting means.

The CRT support means 38 is illustrated more specifically in FIGS. 3 and 4 and comprises a U-shaped base frame 84 formed from hollow, rectangular channel 86 and covers 88 for closing the open ends of the channel 86. A plurality of casters 90 are secured by swivel means 92 to the U-shaped base frame 84, so that it may be rolled over a supporting surface. The U-shaped base frame 84 is located generally in a horizontal plane with the open end of the U-shaped frame 84 facing the operator of the apparatus.

Extending in a vertical direction upwardly from and secured to the base member 94 of the U-shaped base frame 84 are a pair of spaced apart hollow support tubes 96. A cylindrical member 98 is positioned for slidable movement in each of the hollow support tubes 96. Means, such as the locking set screws 100, are provided to secure the cylindrical members 98 at any desired position in the support tubes 96. It is understood that means other than the set screw 100 may be used to secure the cylindrical members 98 at any desired location in the support tubes 96. Also, it is understood that the foregoing cross-sectional configurations of the channel 86, the support tubes 96 and the cylindrical member 98, are for description purposes only and may comprise other cross-sectional configurations.

A U-shaped support bracket 102 is secured to the upper end 104 of end cylindrical member 98 with the open end of the U-shaped support bracket 102 facing upwardly. A support shelf 106 is provided for supporting a CRT. A plurality of U-shaped channel members 108 are secured to the bottom surface 110 of the shelf 106 with the open ends of the U-shaped channel members 108 adjacent to the bottom surface 110. The base 112 of each of the U-shaped channel members 108 has an outer width W less than the inner width $W_1$, of the base 114 of each of the U-shaped support brackets 102 so that each U-shaped channel member 108 may be nested in each U-shaped support bracket 102.

The means for pivotally mounting the shelf 106 on the U-shaped support brackets 102 is illustrated in an exploded veiw in FIG. 3 and in an assembled view in FIG. 4. Each U-shaped channel member 108 is provided with a pair of aligned openings 116 and each U-shaped support bracket is provided with a pair of aligned openings 118. As illustrated in FIG. 4, each U-shaped channel member 108 is nested in one of the U-shaped support brackets 102 so that the openings 116 are aligned with the openings 118. A bolt 120 is passed through the aligned openings 116 and 118. A plurality of lock washers 122, located as illustrated in FIG. 4, are used in conjunction with a nut 124 to retain the shelf in a desired angular relationship with the U-shaped support brackets 102. It is understood that this angular relationship may be changed as desired by simply loosening the nuts 124, moving the shelf 106 to a different angular relationship and then tightening the nuts 124. Means (not shown) may be provided for locating and retaining a CRT in a desired location on the upper surface of the shelf 106.

The CRT support means 38 illustrated in FIG. 3, permits the CRT support means to be moved to any desired location within a three dimensional field and rotation about a horizontal axis and a vertical axis. The relationship of the cylindrical members 98 and the support tubes 96 permits the vertical adjustment of the CRT display unit 42 while the swivelly mounted casters allow for movement in any direction in a horizontal plane. The pivotal means, illustrated particularly in FIG. 4, permits the angular adjustment of the CRT display unit about a horizontal unit. However, the structure illustrated in FIG. 3 provides for only limited movement about a vertical axis obtained primarily by the swivel mounting of the casters 90. If additional movement around a vertical axis is desired, only one support tube 96 and one cylindrical member 98 is used. The support bracket secured to the cylindrical member 98 would be shaped to provide two spaced apart U-shaped support brackets having aligned openings similar to the aligned openings 118. This modified structure would permit pivotal movement about both a vertical axis and a horizontal axis.

It is to be understood that the drawer units may be used to house or store other elements such as paper, storage discs and work product materials. Also, the desk-type work station means may be supported on casters so as to be movable in all directions.

It is contemplated that the inventive concepts herein described may be variously otherwise embodied and it is intended that the appended claims be construed to include alternative embodiments of the invention except insofar as limited by the prior art.

What is claimed is:

1. A desk-type work station for a data processing, computer-type system apparatus comprising:

an upper generally flat top panel means having a central transparent portion, said upper generally flat top panel means also providing support means for work product materials;

a pair of laterally spaced pedestal means for supporting said top panel means and defining a work space therebetween located beneath said central transparent upper panel portion;

a central drawer means beneath said upper generally flat top panel means and between said laterally spaced pedestal means for receiving and supporting a keyboard-type input means;

a support stand means beneath said central transparent portion of said upper flat top panel means for receiving and supporting a display means unit of the system in any position whereat the display means unit is viewable through said central transparent portion;

a first side drawer means mounted in one of said pedestal means for receiving and supporting a printer means unit; and a second side drawer means mounted in another of said pedestal means for receiving and supporting a data storage drive means unit.

2. The invention as defined in claim 1 and further comprising:

means on said support stand means for permitting movement of said support stand means into and out of said any position beneath said central transparent portion.

3. The invention as defined in claim 1 and further comprising:

means on said support stand means for adjusting the angular relationship between said display means unit and said central transparent section.

4. The invention as defined in claim 3 wherein said means on said support stand means for adjusting the angular relationship between said display means unit and said central transparent section comprises:

a shelf for supporting said display means unit;

means for pivotally mounting said shelf on said support stand means; and means for locking said shelf in a desired position so that said display means unit is in a desired angular relationship with said central transparent section.

5. The invention as defined in claim 4 wherein said means for pivotally mounting said shelf on said support stand comprises:

a pair of spaced apart U-shaped channel members secured to a bottom surface of said shelf with the openings of said U-shaped channel members facing said bottom surface;

a pair of aligned openings in each of said U-shaped channel members;

a pair of U-shaped support brackets on said support stand;

a pair of aligned openings in each of said U-shaped support brackets;

said U-shaped channel members and said U-shaped support brackets being dimensioned so that said U-shaped channel members may be nested in said U-shaped support brackets with said openings in said U-shaped channel members in alignment with said openings in said U-shaped support brackets;

a pivot pin passing through said aligned openings so that said U-shaped channel members may pivot relative to said U-shaped support brackets; and means for securing said U-shaped channel members relative to said U-shaped support brackets so as to prevent relative movement therebetween.

6. The invention as defined in claim 4 and further comprising:

means on said support stand means for permitting movement of said support stand means in any direction in a horizontal plane in positions beneath said central transparent means including movement of said support stand means into and out of a location beneath said central transparent means.

7. The invention as defined in claim 6 wherein said means for pivotally mounting said shelf on said support stand comprises:

a pair of spaced apart U-shaped channel members secured to a bottom surface of said shelf with the openings of said U-shaped channel members facing said bottom surface;

a pair of aligned openings in each of said U-shaped channel members;

a pair of U-shaped support brackets on said support stand;

a pair of aligned openings in each of said U-shaped support brackets;

said U-shaped channel members and said U-shaped support brackets being dimensioned so that said U-shaped channel members may be nested in said U-shaped support brackets with said openings in said U-shaped channel members in alignment with said openings in said U-shaped support brackets;

a pivot pin passing through said aligned openings so that said U-shaped channel members may pivot relative to said U-shaped support brackets; and means for securing said U-shaped channel members relative to said U-shaped support brackets so as to prevent relative movement therebetween.

8. The invention as defined in claim 3 and further comprising:

means on said support stand means for permitting movement of said support stand means in any direction in a horizontal plane in positions beneath said central transparent means including movement of said support stand means into and out of a location beneath said central transparent means.

9. The invention as defined in claim 8 and further comprising:

means on said support stand means for permitting the vertical adjustment of said display means unit.

10. The invention as defined in claim 9 wherein said means on said support stand means for adjusting the angular relationship between said display means unit and said central transparent section comprises:

a shelf for supporting said display means unit; means for pivotally mounting said shelf on said support stand means; and means for locking said shelf in a desired position so that said display means unit is in a desired angular relationship with said central transparent section.

11. The invention as defined in claim 10 wherein said means for pivotally mounting said shelf on said support stand comprises:

a pair of spaced apart U-shaped channel members secured to a bottom surface of said shelf with the openings of said U-shaped channel members facing said bottom surface;

a pair of aligned openings in each of said U-shaped channel members;

a pair of U-shaped support brackets on said support stand;

a pair of aligned openings in each of said U-shaped support brackets;

said U-shaped channel members and said U-shaped support brackets being dimensioned so that said U-shaped channel members may be nested in said U-shaped support brackets with said openings in said U-shaped channel members in alignment with said openings in said U-shaped support brackets;

a pivot pin passing through said aligned openings so that said U-shaped channel members may pivot relative to said U-shaped support brackets; and means for securing the U-shaped channel members relative to said U-shaped support brackets so as to prevent relative movement therebetween.

12. The invention as defined in claim 1 and further comprising:

means on said support stand means for permitting movement of said support stand means in any direction in a horizontal plane in positions beneath said central transparent means including movement of said support stand means into and out of a location beneath said central transparent means.

13. The invention as defined in claim 12 wherein said means permitting movement of said support stand means in any direction in a horizontal plane comprises:

a plurality of swivelly mounted casters; and said casters also permitting rotational movement of said support stand means around a vertical axis.

14. The invention as defined in claim 1 and further comprising:

means on said support stand means for permitting movement of said display means unit anywhere within a three dimensional field and pivotal about a horizontal axis and rotatable about a vertical axis.

15. The invention as defined in claim 14 and further comprising:

storage space means in said side drawer means adjacent to said printer.

16. The invention as defined in claim 15 and further comprising:

storage means in said side drawer means adjacent to said data storage drive means unit.

17. The invention as defined in claim 16 and further comprising:

a plurality of adjustable shelves in said storage means adjacent to said data storage drive means unit.

18. The invention as defined in claim 17 and further comprising:

a front panel means extending downwardly from one side of said upper generally flat top panel means; and a plurality of openings in said front panel means for permitting movement of conditioning air into areas adjacent to said keyboard-type input means, said display means unit, said printer and said data storage drive means unit.

19. The invention as defined in claim 17 and further comprising:

a plurality of handle means in said front panel means.

20. A desk-type work station for a data processing, computer-type system apparatus comprising:

an upper generally flat top panel means having a central transparent panel portion, said upper generally flat top panel means also providing support means for work product materials;

a pair of laterally spaced pedestal means for supporting said top panel means and defining a work space therebetween located beneath said central transparent upper panel portion;

a central keyboard support means beneath said upper generally flat top panel means and between said laterally spaced pedestal means for receiving and supporting a keyboard-type input means;

a central display means beneath said central transparent portion of said upper flat top panel means for receiving and supporting a display means unit of the system in a position whereat the display means unit is viewable through said central transparent portion;

a printer support means located beneath said flat top panel means for receiving and supporting a printer means unit; and a data storage drive support means located beneath said flat top panel means for receiving and supporting a data storage drive means unit.

* * * * *